United States Patent [19]

Evans et al.

[11] Patent Number: 4,698,064

[45] Date of Patent: Oct. 6, 1987

[54] USE OF SULFONATED 2-(2'-HYDROXYARYL)-S-TRIAZINES AS PHOTOSTABILIZING AGENTS FOR WOOL AND OTHER PROTEIN FIBRES

[75] Inventors: Neil A. Evans, East Ivanhoe; Brian Milligan, North Balwyn; Peter J. Waters, Gladstone Park, all of Australia

[73] Assignee: Commonwealth Scientific and Industrial Research Org., Campbell, Australia

[21] Appl. No.: 905,384

[22] PCT Filed: Nov. 29, 1985

[86] PCT No.: PCT/AU85/00297

§ 371 Date: Aug. 7, 1986

§ 102(e) Date: Aug. 7, 1986

[87] PCT Pub. No.: WO86/03528

PCT Pub. Date: Jun. 19, 1986

[30] Foreign Application Priority Data

Dec. 7, 1984 [AU] Australia ..... PG8461

[51] Int. Cl.[4] ..... D06M 3/02; D06M 13/00

[52] U.S. Cl. ..... 8/128 R

[58] Field of Search ..... 8/128 R

[56] References Cited

FOREIGN PATENT DOCUMENTS 1494413 9/1966 France .

OTHER PUBLICATIONS

*Helv Chim Acta,* 1972, 55, 1566.

*Primary Examiner*—Paul Lieberman
*Assistant Examiner*—John F. McNally
*Attorney, Agent, or Firm*—Arnold, White & Durkee

[57] ABSTRACT

A method for protecting proteinaceous fibres, either dyed or in their natural form, against photodegradation and thermal degradation. The method comprises treating the fibres with a sulfonated s-triazine derivative of formula (I), wherein $R^1$ is hydrogen, alkyl, hydroxyl, O-alky, OOC-alkyl or OOCNH-alkyl; $R^2$ is hydrogen, alkyl or $SO_3X$; $R^3$ is aryl, substituted aryl or O-alkyl; and X is hydrogen, $NH_4$ or alkali metal, or formula (II), wherein $R^1$ and $R_4$ are hydrogen, alkyl, hydroxyl, O-alkyl, OCC-alkyl or OOCNH-alkyl; $R^2$ and $R^5$ are hydrogen, alkyl or —$SO_3X$; $R^3$ is hydrogen or —$SO_3X$; $R^6$ is aryl, substituted aryl, O-alkyl or O-aryl; and X is hydrogen, $NH_4$ or alkali metal; under acidic conditions. The method is particularly suitable for treating dyed and undyed wool, silk, mohair and cashmere fibers, including blends thereof.

9 Claims, No Drawings

USE OF SULFONATED 2-(2'-HYDROXYARYL)-S-TRIAZINES AS PHOTOSTABILIZING AGENTS FOR WOOL AND OTHER PROTEIN FIBRES

This invention relates to a method for protecting wool and other proteinaceous fibrous materials against photodegradation by the use of sulfonated 2-hydroxyphenyl-s-triazine derivatives.

Sunlight damages textile materials in several ways. Undyed wool fabrics frequently turn yellow while dyed fabrics may undergo both photoyellowing and dye fading. Sunlight damage also manifests itself as a loss in strength and abrasion resistance of fabrics, a phenomenon generally referred to as phototendering. Wool curtains and automotive upholstery are especially prone to photo-tendering, particularly in hot, sunny regions. Prolonged exposure to heat alone also causes wool fabrics to become yellow, albeit at a slower rate than does exposure to sunlight and heat together.

It is well known that most synthetic fibres and plastics are damaged by light, and it is commonplace for additives, including ultraviolet absorbers, to be added to these materials before or during fabrication to retard subsequent damage by exposure to sunlight. There are many types of ultraviolet absorber, the 2-hydroxybenzophenones, 2,2'-dihydroxybenzophenones and 2-hydroxyphenylbenzotriazoles being the most widely known and used. 2-Hydroxyphenyl-s-triazines are also well known UV-absorbers, although they are not widely used. All these UV-absorbers are generally believed to function primarily by preferentially absorbing the incident ultraviolet light and dissipating its energy harmlessly, thus minimising damage to the treated fibrous or plastic material. They probably also function by scavenging radical species produced during exposure.

The vast majority of UV-absorbers are unsulfonated compounds, because their apolar nature makes them more suitable for application to most synthetic fibres and plastics. However, wool, silk and other protein fibres, being polar fibres containing cationic groups, are much more amenable to treatment with sulfonated (anionic) UV-absorbers than with the non-sulfonated parent compounds.

Sulfonated UV-absorbers of the 2-hydroxybenzophenone, 2,2'-dihydroxybenzophenone and 2-hydroxyphenylbenzotriazole types have been described previously, and recommended as photoprotective agents for wool, nylon and other polar fibres.

See for example:

1. Comparison of Ultraviolet Light Absorbers for Protection of Wool against Yellowing, W. G. Rose, M. K. Walden and J. E. Moore, *Text. Res. J.* 1961, 31, 495.
2. Use of 2,4-Dihydroxybenzophenone-2-ammonium Sulphonate to Prevent the Yellowing of Wool by Ultraviolet Radiation, J. Cegarra, J. Ribe and P. Miro, *J. Soc. Dyers Colour.*, 1972, 88, 293.
3. Ultraviolet Absorbers for Retarding Wool Photodegradation: Sulphonated Long-chain Substituted 2-Hydroxybenzophenones, B. Milligan and L. A. Holt, *Polym. Degr. Stab.*, 1983, 5, 339.
4. Ultraviolet Absorbers for Retarding Wool Photodegradation: Sulphonated 2-Hydroxybenzophenones and 2,2'-Dihydroxybenzophenones, B. Milligan and L. A. Holt, *Polym. Degr. Stab.*, 1985, 10, 335.

5. CIBA Ltd., German Pat. No. 1282019 (Nov. 7, 1968).
6. Use of Ultraviolet Absorbers for Reducing the Chemical and Physical Damage Caused by Prolonged Exposure of Wool to Light, P. J. Waters, N. A. Evans, L. A. Holt and B. Milligan, *Proc. Int. Wool Text. Res. Conf.*, Pretoria, 1980, V, 195.
7. Dual Role of a Hydroxyphenylbenzotriazole UV-Absorber in the Photooxidation of Wool, I. H. Leaver, P. J. Waters and N. A. Evans, *J. Polym. Sci., Polym. Chem. Edn.*, 1979, 17, 1531.
8. Use of Substituted 2-(2'-hydroxyaryl)-2H-benzotriazole sulfonates as Photostabilising Agents for Natural and Synthetic Fibres, CSIRO, European Patent Appl. No. 83307443.8 (Dec. 7, 1983).

Unsulfonated absorbers of the 2-hydroxyphenyl-s-triazine type are well known—see, for example:

1. Hydroxyaryl-1,3,5-triazines. CIBA Ltd., French Pat. No. 1387435 (Jan. 29, 1965).
2. Hydroxyphenyl-s-triazines. CIBA Ltd., Belgian Pat. No. 661225 (Sept. 17, 1965).
3. Hydroxyphenyl-1,3,5-triazine ultraviolet absorbers. CIBA Ltd., Netherlands Pat. No. 6408514 (Jan. 27, 1965).
4. Die Synthese von asymmetrisch substituierten o-Hydroxyphenyl-s-triazinen, H. Brunetti and C. E. Luthi, *Helv. Chim. Acta.*, 1972, 55, 1566.

However, sulfonated UV-absorbers of the 2-hydroxyphenyl-s-triazine type are almost unknown, the only examples containing ω-sulfoalkyloxy groups (see 'Hydroxyphenyl-1,3,5-triazine derivatives containing sulfonic groups for use as stabilisers for perfumes, soaps, plastic films and photographic gelatin compositions'. CIBA Ltd., French Pat. No. 1494413, Sept. 8, 1967). No claim was made for the use of these compounds on natural or synthetic fibres.

The sulfonated 2-hydroxyphenyl-s-triazines described herein differ from the above compounds in that the sulfonic acid groups are attached directly to aromatic rings. Several of these UV-absorbers are more effective photostabilizers for wool (against both phototendering and photoyellowing) than are any sulfonated 2-hydroxybenzophenones, and are also more effective than most known sulfonated 2-hydroxyphenylbenzotriazoles. They also give protection to dyed wool, retarding both phototendering and colour change. This reduction of colour change by the sulfonated 2-hydroxyphenyl-s-triazines is due to minimized yellowing and reduced dye fading.

It is therefore an object of the present invention to provide a method to protect proteinaceous fibrous materials, such as wool, mohair, cashmere and silk, from photoyellowing, phototendering and thermal yellowing, and to protect dyed proteinaceous fibrous materials from both phototendering and colour change. According to the present invention, there is provided a method of protecting proteinaceous fibres and blends thereof against photodegradation and thermal degradation, which comprises treating the fibres under acidic conditions with a sulfonated s-triazine derivative of formula I or II:

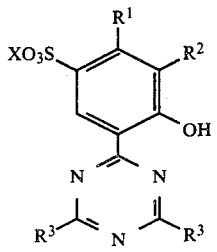

I wherein $R^1$ is H, alkyl, OH or O-alkyl, OOC-alkyl or OOCNH-alkyl;

$R^2$ is H, alkyl or $—SO_3X$;

$R^3$ is aryl, substituted aryl or O-alkyl; and

X is H, $NH_4$ or alkali metal;

OR

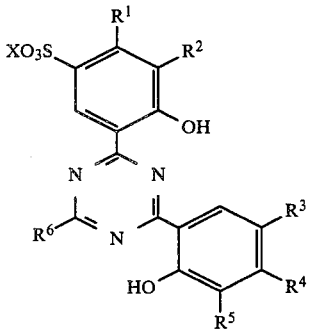

II wherein $R^1$ and $R^4$ are H, alkyl, OH or O-alkyl, OOC-alkyl or OOCNH-alkyl;

$R^2$ and $R^5$ are H, alkyl or $—SO_3X$;

$R^3$ is H or $—SO_3X$;

$R^6$ is aryl, substituted aryl, O-alkyl or O-aryl; and

X is H, $NH_4$ or alkali metal.

In each case the preferred aryl group is phenyl; and preferred substituted aryl groups are alkyl substituted phenyl groups. Preferred alkyl groups include methyl, ethyl, n-propyl, i-propyl, n-butyl and i-butyl; preferred alkali metal is sodium.

Preferred sulfonated s-triazine derivatives of the formula I are compounds of that formula in which $R^1$ is a methoxy, ethoxy, propyloxy, butyloxy or acetoxy group, $R^2$ is hydrogen, $R^3$ is a phenyl group or an alkyl-substituted phenyl group, and X is sodium. Preferred derivatives of the formula II are compounds of that formula in which $R^1$ and $R^4$ are methoxy, ethoxy, propyloxy, butyloxy or acetoxy groups, $R^2$ and $R^5$ are hydrogen, $R^3$ is hydrogen or a sulfonate group, $R^6$ is phenyl or alkyl-substituted phenyl, and X is sodium.

Particularly preferred sulfonated s-triazine derivatives for use in the method of this invention are the ammonium, sodium or potassium salts of:

2,4-diphenyl-6-(2'-hydroxy-4'-methoxy-5'-sulfophenyl)-s-triazine, 2,4-bis(2',4'-dimethylphenyl)-6-(2''-hydroxy-4''-acetoxy-5''-sulfophenyl)-s-triazine, 2,4-diphenyl-6-(2'-hydroxy-4'-n-butoxy-5'-sulfophenyl-s-triazine, 2,4-bis(2',4'-dimethylphenyl)-6-(2''-hydroxy-4''-methoxy-5''-sulfophenyl)-s-triazine, 2,4-diphenyl-6-(2'-hydroxy-4'-acetoxy-5'-sulfophenyl)-s-triazine, or 2,4-di-p-tolyl-6-(2'-hydroxy-4'-methoxy-5'-sulfophenyl)-s-triazine.

Fibres found to be especially amenable to the process are wool, mohair, and silk and blends thereof, whether dyed or not. Preferably, the treatment of the fibres is carried out at a pH within the range of 1.5–6.

Preferred embodiments of the invention will now be described with reference to the following examples which illustrate the extent of photodegradation in wool and silk samples treated with the sulfonated 2-hydroxyphenyl-s-triazines according to invention. The extent of phototendering was usually determined by measuring the breaking load of unexposed and exposed fabric strips, although in some cases abrasion resistance and tear strengths were also determined. The extent of photoyellowing and thermal yellowing was determined by measurement of yellowness index values on a single thickness of fabric, using a computerised reflectance spectrophotometer (Spectrogard Color System, Pacific Scientific Ltd.). The extent of colour change, ΔE (CIE Lab system), of dyed fabrics was also measured using this instrument. The extent of thermal yellowing was measured after heating fabric samples in a circulating air oven at 115° C. for 6 days.

Unless otherwise stated in the Examples, the ultraviolet absorbers (5% owf) were normally applied to the fabric at 80° C. for 90 minutes from an aqueous dyebath (liquor:wool ratio=60:1) containing sulfuric acid (4% owf) using an Ahiba laboratory dyeing machine. Absorber uptakes (as measured by optical density changes of the dyebaths) ranged from 90–100%.

Treated, untreated and control fabric samples (150 mm×100 mm) were exposed for up to 2000h at a distance of 200 mm from a mercury vapor-tungsten phosphor lamp (Philips ML, 500W type), which is considered to provide irradiation similar to that of sunlight. Fabrics were usually exposed for 2000h at an air temperature of 45° C. or for 1000h at 70° C.

Sunlight exposures were conducted on fabric samples (150 mm×100 mm) at the Allunga Exposure Laboratory, a commercial testing facility at Townsville, Queensland. Fabrics were exposed on racks behind window glass inclined at 20° to the horizontal and facing North.

Breaking loads were determined in the weft direction on conditioned (20° C., 65% rh) fabric strips (weft 50 mm and warp 25 mm; rate of extension 50 mm/min) using an Instron tensile tester (model TM). Tear strengths were determined by the method described in ASTM, D 2261. Abrasion resistance was measured with a Taber Abraser, as described by P. J. Waters and N. A. Evans (*J. Text. Inst.*, 1983, 74, 99). The results quoted are the means of 3–6 measurements. The results are collected in the following Examples. Examples 1–11 are concerned with wool [including dyed wool (see Example 10)], and Example 12 with silk.

EXAMPLE 1

Protection of Wool from Phototendering and Photoyellowing in Simulated Sunlight: Effectiveness of Various Sulfonated 2-Hydroxyphenyl-s-Triazines

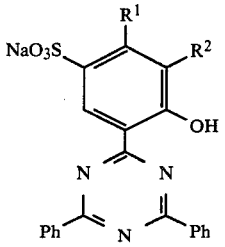

.5% on the weight of wool
.applied at pH 2, 80° C., 1.5 h

| Substituents | | Breaking Load (lb) | | Residual | Yellowness Index | |
|---|---|---|---|---|---|---|
| | | before | after | Strength | before | after |
| $R^1$ | $R^2$ | exposure | exposure[a] | (%) | exposure | exposure[a] |
| untreated | | 22.0 | 2.4 | 11 | 15 | 34 |
| H | H | 23.8 | 12.1 | 51 | 16 | 25 |
| H | Me | 23.0 | 11.5 | 50 | 18 | 34 |
| OH | H | 23.7 | 11.0 | 50 | 19 | 26 |
| OH | Me | 23.5 | 18.2 | 77 | 21 | 47 |

[a]to a 500 W Philips ML lamp for 2000 h at 45° C.

EXAMPLE 2

Protection of Wool from Phototendering and Photoyellowing in Simulated Sunlight: Effectiveness of Various Sulfonated 2-Hydroxyphenyl-s-Triazines

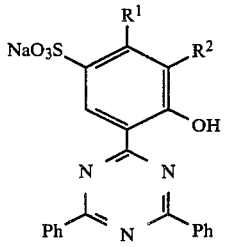

.5% on the weight of wool
.applied at pH 2, 80° C., 1.5 h

| Substituents | | Breaking Load (lb) | | Residual | Yellowness Index | |
|---|---|---|---|---|---|---|
| | | before | after | Strength | before | after |
| $R^1$ | $R^2$ | exposure | exposure[a] | (%) | exposure | exposure[a] |
| untreated | | 22.0 | 2.7 | 12 | 15 | 55 |
| OH | H | 23.7 | 12.7 | 54 | 19 | 41 |
| OMe | H | 23.7 | 15.4 | 65 | 17 | 37 |
| $OBu^n$ | H | 22.8 | 16.0 | 70 | 17 | 37 |
| OH | $SO_3Na$ | 23.1 | 12.5 | 54 | 21 | 42 |

[a]to a 500 W Philips ML lamp for 1000 h at 70° C.

EXAMPLE 3

Protection of Wool from Phototendering in Simulated Sunlight: Effectiveness of Various Sulfonated 2-Hydroxyphenyl-s-Triazines

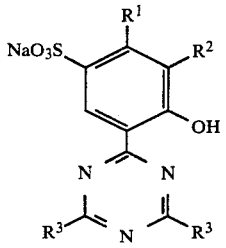

.5% on the weight of wool
.applied at pH 2, 80° C., 1.5 h

| Substituents | | | Breaking Load (lb) | | Residual |
|---|---|---|---|---|---|
| | | | before | after | |
| $R^1$ | $R^2$ | $R^3$ | exposure | exposure[a] | Strength (%) |
| untreated | | | 22.0 | 2.6 | 12 |
| OH | $SO_3Na$ | Ph | 23.1 | 12.5 | 54 |
| OH | $SO_3Na$ | 4-Me Ph | 23.4 | 12.5 | 53 |
| OMe | H | Ph | 23.1 | 15.4 | 65 |
| OMe | H | 4-MePhh | 23.6 | 13.8 | 59 |
| OMe | H | 2,4-$Me_2$Ph | 22.8 | 15.7 | 69 |
| OAc | H | Ph | 23.3 | 13.7 | 59 |
| OAc | H | 2,4-$Me_2$Ph | 22.9 | 11.3 | 49 |

[a]to a 500 W Philips ML lamp for 1000 h at 70° C.

EXAMPLE 4

Protection of Wool from Phototendering in Simulated Sunlight: Effectiveness of Various Sulfonated 2-Hydroxyphenyl-s-Triazines

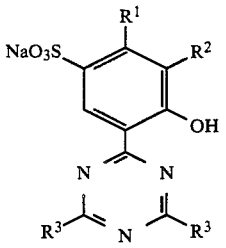

.5% on the weight of wool
.applied at pH 2, 80° C., 1.5 h

| Substituents | | | Breaking Load (lb) | | Residual |
|---|---|---|---|---|---|
| | | | before | after | |
| $R^1$ | $R^2$ | $R^3$ | exposure | exposure[a] | Strength (%) |
| untreated | | | 22.0 | 2.1 | 10 |
| OH | H | Ph | 23.7 | 11.8 | 50 |
| OH | H | OPh | 23.5 | 2.7 | 12 |
| OH | Me | Ph | 23.5 | 18.2 | 77 |
| OH | Me | OPh | 23.3 | 3.4 | 15 |
| OMe | H | Ph | 23.7 | 15.4 | 65 |
| OMe | H | OPh | 24.2 | 3.0 | 12 |

[a]to a 500 W Philips ML lamp for 2000 h at 45° C.

EXAMPLE 5

Protection of Wool from Phototendering in Simulated Sunlight: Effectiveness of Various Sulfonated Bis(2-Hydroxyphenyl)-s-Triazines

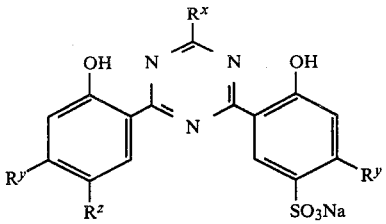

.5% on the weight of wool
.applied at pH 2, 80° C., 1.5 h

| Substituents | | | Breaking Load (lb) | | |
|---|---|---|---|---|---|
| $R^x$ | $R^y$ | $R^z$ | before exposure | after exposure[a] | Residual Strength (%) |
| | untreated | | 22.0 | 2.7 | 12 |
| Ph | H | H | 23.5 | 13.0 | 55 |
| Ph | H | $SO_3Na$ | 23.3 | 10.5 | 45 |
| OPh | OH | $SO_3Na$ | 23.6 | 11.7 | 50 |

[a]to a 500 W Philips ML lamp for 2000 h at 45° C.

EXAMPLE 6

Protection of Wool from Phototendering in Simulated Sunlight by the Sulfonated Triazine I: Effect of Concentration

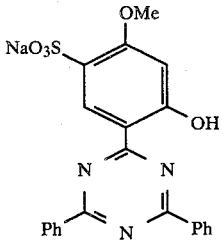

applied at pH 2, 80° C., 1.5 h

| Amount of Absorber (% on weight of wool) | Breaking Load (lb) before exposure | after exposure[a] | Residual Strength (%) |
|---|---|---|---|
| - (untreated) | 22.7 | 2.5 | 11 |
| - (control) | 23.1 | 3.1 | 13 |
| 1 | 22.8 | 7.1 | 31 |
| 3 | 23.5 | 13.0 | 55 |
| 5 | 23.6 | 17.1 | 73 |

[a]to a 500 W Philips ML lamp for 1000 h at 70° C.

EXAMPLE 7

Protection of Wool from Phototendering in Simulated Sunlight by the Sulfonated Triazine I: Effect pH of Application

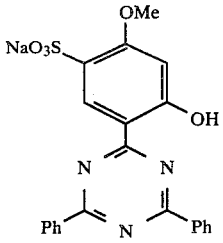

.5% on the weight of wool
.applied at pH 2, 80° C., 1.5 h

| Absorber[a] | pH | Breaking Load (lb) before exposure | after exposure[b] | Residual Strength (%) |
|---|---|---|---|---|
| A | 2 | 23.1 | 3.5 | 15 |
| P | 2 | 23.6 | 17.9 | 76 |
| A | 4 | 24.6 | 2.2 | 9 |
| P | 4 | 25.8 | 13.2 | 51 |
| A | 5.5 | 25.1 | 2.7 | 11 |
| P | 5.5 | 25.7 | 9.6 | 37 |
| untreated | | 22.7 | 2.2 | 10 |

[a]A = absent, P = present
[b]to a 500 W Philips ML lamp for 1000 h at 70° C.

EXAMPLE 8

Protection of Wool Fabric from Phototendering in Simulated Sunlight[a]: Breaking Load, Abrasion Resistance and Tear Strength

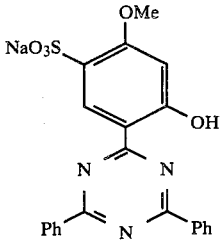

.5% on the weight of wool
.applied at pH 2, 80° C., 1.5 h

| Sample | Exposure time (h) | Breaking Load[b] | Abrasion Resistance[b] | Tear Strength[b] |
|---|---|---|---|---|
| Untreated | 500 | — | 67 | 36 |
| Treated | 500 | — | 94 | 62 |
| Untreated | 1000 | 33 | 33 | 11 |
| Treated | 1000 | 92 | 84 | 51 |
| Untreated | 2000 | 7 | 13 | — |
| Treated | 2000 | 64 | 75 | — |

[a]to a Philips ML lamp at 45° C.
[b]as a percentage of the corresponding value for unexposed fabric.

EXAMPLE 9

Protection of Wool from Phototendering and Photoyellowing During Exposure to Sunlight Through Window Glass[a]

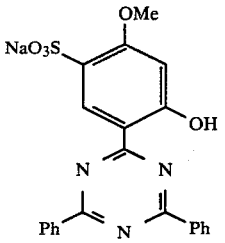

.applied at pH 2, 80° C., 1.5 h

| Treatment conditions | | | Yellowness Index | |
|---|---|---|---|---|
| Absorber (% owf) | pH | Residual Strength (%) | before exposure | after exposure[a] |
| untreated | | 9 | 14 | 34 |
| 1 | 2 | 20 | 15 | 24 |
| 2 | 2 | 39 | 16 | 23 |
| 3 | 2 | 48 | 16 | 22 |
| 5 | 2 | 60 | 17 | 23 |
| 5 | 4 | 54 | 18 | 22 |
| 5 | 5.5 | 41 | 18 | 19 |

[a]to spring/summer sunlight through domestic window glass in Townsville, Queensland for 5 months (60,000 Langleys).

[b]breaking load, as a percentage of that of an unexposed sample.

EXAMPLE 10

Protection Against Phototendering and Color Change During Exposure of Dyed Fabrics to Simulated Sunlight[a] and to Sunlight Through Window Glass[b]

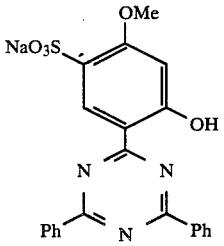

.2% absorber on the weight of wool
.1% dye on the weight of wool

| | | Simulated | Sunlight | Sunlight/glass | |
|---|---|---|---|---|---|
| Dye[c] | Absorber | Residual strength[d] (%) | Color difference[e] (ΔE) | Residual strength[d] (%) | Color difference[e] (ΔE) |
| untreated | | 5 | 32 | 6 | 8 |
| A | A | 7 | 35 | 6 | 8 |
| A | P | 25 | 22 | 45 | 1 |
| Bordeaux | A | 13 | 23 | 12 | 15 |
| " | P | 30 | 13 | 29 | 11 |
| Green | A | 14 | 23 | 9 | 25 |
| " | P | 27 | 16 | 26 | 20 |
| Yellow | A | 16 | 14 | 13 | 21 |
| " | P | 35 | 12 | 47 | 13 |
| Grey | A | 15 | 20 | 8 | 19 |

-continued

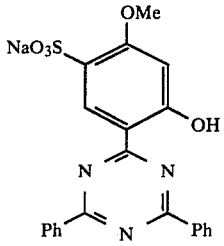

.2% absorber on the weight of wool
.1% dye on the weight of wool

| | | Simulated | Sunlight | Sunlight/glass | |
|---|---|---|---|---|---|
| Dye[c] | Absorber | Residual strength[d] (%) | Color difference[e] (ΔE) | Residual strength[d] (%) | Color difference[e] (ΔE) |
| " | P | 34 | 13 | 29 | 13 |

[a]a 500 W Philips ML lamp for 1000 h at 70° C.

[b]summer/autumn exposure (4.5 months) through domestic glass in Melbourne.

[c]The dyes were applied to wool in the absence (A) or presence (P) of the absorber I, initially at pH 4.5 (50° C. → 100° C., 1.5 h) and finally at pH 2, 100° C. for 0.2 h. Isolan K premetallised dyes (Bayer) were used.

[d]breaking load, as a percentage of that of an unexposed sample.

[e]between the unexposed and exposed fabrics, measured with a computerised reflectance spectrophotometer.

EXAMPLE 11

Protection of Wool from Yellowing by Heat

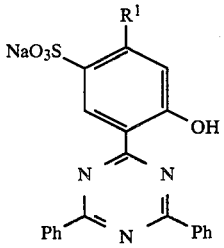

.5% absorber on the weight of wool
.applied at pH 2, 80° C., 1.5 h

| Substituent | Yellowness Index | |
|---|---|---|
| $R^1$ | before heating | after heating[a] |
| untreated | 15 | 30 |
| H | 16 | 27 |
| OH | 19 | 29 |
| OMe | 17 | 27 |

[a]in a circulating air oven at 115° C., for 6 days.

EXAMPLE 12

Protection of Silk from Phototendering and Photoyellowing in Simulated Sunlight[a]

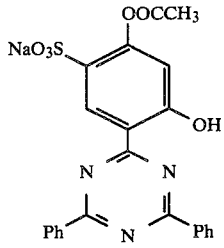

.5% absorber on the weight of silk
.applied at pH 2, 80° C., 1.5 h

| Sample | Residual strength[b] | Yellowness Index before exposure | Yellowness Index after exposure |
|---|---|---|---|
| untreated | 12 | 5 | 10 |
| control | 8 | 6 | 12 |
| treated | 23 | 7 | 9 |

[a]a 500 W Philips ML lamp for 500 h at 45° C.
[b]breaking load as a percentage of the value for an unexposed sample.

An assessment of the data collected in the examples leads to the following general conclusions:

1. Most of the sulfonated 2-hydroxyphenyl-s-triazine derivatives listed in the tables protect wool against phototendering (Examples 1–10).

2. Some, but not all, of these triazines retard the photoyellowing of wool during exposure to simulated sunlight (Examples 1 and 2) or to sunlight through glass (Example 9).

3. The introduction of a 4-alkoxy group into a sulfonated 2-hydroxyphenyl-s-triazine derivative increases the level of protection against phototendering and photoyellowing (Example 2).

4. Sulfonated 2-hydroxyphenyl-s-triazines containing two phenyl or p-tolyl groups provide good protection against phototendering (Example 3), but those containing two phenoxy groups do not (Example 4).

5. Both mono-sulfonated and di-sulfonated 2-hydroxyphenyl-s-triazines provide protection against phototendering (Examples 2 and 5).

6. Sulfonated s-triazines containing two 2-hydroxyphenyl groups are also effective photostabilisers for wool (Example 5).

7. The degree of photoprotection increases as the concentration of sulfonated 2-hydroxyphenyl-s-triazine in wool is increased (Example 6).

8. The degree of photoprotection increases as the pH at which the sulfonated 2-hydroxyphenyl-s-triazine is applied is lowered (Example 7).

9. A sulfonated 2-hydroxyphenyl-s-triazine which reduces losses in breaking load of wool fabric caused by exposure to simulated sunlight also reduces losses in abrasion resistance and tear strength (Example 8).

10. A sulfonated 2-hydroxyphenyl-s-triazine which provides photoprotection against simulated sunlight (Tables 2, 6 and 7) also retards phototendering and photoyellowing caused by exposure to sunlight through glass (Example 9).

11. Application of a sulfonated 2-hydroxyphenyl-s-triazine to dyed wool retards both phototendering and color change (Example 10).

12. Sulfonated 2-hydroxyphenyl-s-triazines reduce thermal yellowing of wool fabrics (Example 11).

13. A sulfonated 2-hydroxyphenyl-s-triazine protects silk against both phototendering and photoyellowing (Example 12).

Most of the sulfonated s-triazine derivatives shown in Examples 1–12 were prepared by sulfonating the parent s-triazine derivatives, either with chlorosulfonic acid or with fuming sulfuric acid. The preparation of six sulfonated s-triazine UV-absorbers is described below.

PREPARATION OF SULFONATED 2-HYDROXYARYL-s-TRIAZINES AND BIS-2-HYDROXYARYL-s-TRIAZINES

2,4-Diphenyl-6-(2'-hydroxy-4'-methoxy-5'-sulfophenyl)-s-triazine, sodium salt 2,4-Dihydroxybenzoic acid was converted to 2-hydroxy-4-methoxybenzoic acid by treatment with dimethyl sulfate according to the procedure of M. Gomberg and L. C. Johnson (*J. Amer. Chem. Soc.*, 1917, 39, 1687). Treatment of 2-hydroxy-4-methoxybenzoic acid with phenol and phosphorus oxychloride according to the general method of N. G. Gaylord and P. M. Kamath (*Organic Syntheses*, Coll. Vol. IV, p. 178, 1963) gave phenyl 2-hydroxy-4-methoxybenzoate in 66% yield. Reaction of this phenyl ester with two molar equivalents of benzamidine in boiling ethanol for 20 hours gave a precipitate of 2,4-diphenyl-6-(2'-hydroxy-4'-methoxyphenyl)-s-triazine, which recrystallised from formdimethylamide as pale yellow needles, m.p. 211°–212° C., in 44% yield. Elemental analysis: C, 74.0%; H, 4.4%; N, 11.6%. $C_{22}H_{17}N_3O_2$ requires C, 74.4%; H, 4.8%; N, 11.8%. This compound was then sulfonated by treatment with 1.1 molar equivalents of chlorosulfonic acid in boiling chlorobenzene for one hour. The resultant precipitate was collected, rinsed with light petroleum, and treated with sodium hydroxide solution to give the sodium salt of 2,4-diphenyl-6-(2'-hydroxy-4'-methoxy-5'-sulfophenyl)-s-triazine. It was obtained in 87% yield after recrystallisation from 30% aqueous ethanol. Elemental analysis: C, 55.6%; H, 3.6%; N, 9.0%; S, 6.4%. $C_{22}H_{16}N_3O_5SNa.1H_2O$ requires C, 55.6%; H, 3.6%; N, 8.8%; S, 6.7%.

2,4-Di-p-tolyl-6-(2'-hydroxy-4'-methoxy-5'-sulfophenyl)-s-triazine, sodium salt 2-(2',4'-Dihydroxyphenyl)-4,6-di-p-tolyl-s-triazine was prepared from cyanuric chloride in a four-step synthesis according to H. Brunetti and C. E. Luthi (*Helv. Chim. Acta*, 1972, 55, 1566). Methylation with methyl iodide and potassium carbonate in formdimethylamide gave 2,4-di-p-tolyl-6-(2'-hydroxy-4'-methoxyphenyl)-s-triazine in 93% yield. It crystallised from ethyl acetate as yellow needles, m.p. 235° C. Elemental analysis: C, 75.2%; H, 5.1%; N, 10.6%. $C_{24}H_{21}N_3O_2$ requires C, 75.2%; H, 5.5%; N, 11.0%. Sulfonation with 1.1 equivalents of chlorosulfonic acid in boiling chlorobenzene for 1 hour, followed by conversion to the sodium salt and recrystallisation from 70% aqueous ethanol, gave the sodium salt of 2,4-di-p-tolyl-6-(2'-hydroxy-4'-methoxy-5'-sulfophenyl)-s-triazine as colorless needles in 82% yield. Element analysis: C, 57.5%; H, 4.1%; N, 8.4%; S, 6.6%. $C_{24}H_{20}N_3O_5SNa.1H_2O$ requires C, 57.2%; H, 4.4%; N, 8.3%; S, 6.4%.

2-(2',4'-Dihydroxy-3',5'-disulfophenyl)-4,6-di-p-tolyl-s-triazine, disodium salt Sulfonation of the above-mentioned 2-(2',4'-dihydroxyphenyl)-4,6-di-p-tolyl-s-triazine with 2.5 equivalents of chlorosulfonic acid in boiling chlorobenzene for 1 hour, followed by treatment of the resultant precipitate with excess sodium hydroxide solution, gave the product as a trisodium salt (61% yield). Recrystallisation from 50% aqueous ethanol containing a little acetic acid gave the pale yellow disodium salt. Elemental analysis: C, 43.6%; H, 3.7%; N, 6.7%; S, 10.1%. $C_{23}H_{17}N_3O_8S_2Na_2.3H_2O$ requires C, 44.0%; H, 3.7%; N, 6.7%; S, 10.1%.

2-(2'-Hydroxyphenyl)-4-(2''-hydroxy-5''-sulfophenyl)-6-phenyl-s-triazine, sodium salt 2,4-Bis(2'-hydroxyphenyl)-6-phenyl-s-triazine, prepared by the method of H. Brunetti and C. E. Luthi (*Helv. Chim. Acta,* 1972, 55, 1566), was sulfonated with one molar equivalent of chlorosulfonic acid in boiling chlorobenzene, and the product was converted to the sodium salt by addition of aqueous sodium hydroxide. Recrystallisation from aqueous 2-methoxyethanol gave the above sodium salt in 53% yield. Elemental analysis: C, 54.7%; H, 3.5%; N, 9.3%; S, 7.0%. $C_{21}H_{14}N_3O_5SNa.1H_2O$ requires C, 54.7%; H, 3.5%; N, 9.1%; S, 7.0%.

2,4-Bis(2',4'-dimethylphenyl)-6-(2''-hydroxy-4''-acetoxy-5''-sulfophenyl)-s-triazine, sodium salt 2,4-Bis(2',4'-dimethylphenyl)-6-(2'',4''-dihydroxyphenyl)-s-triazine was prepared from resorcinol and 2-chloro-4,6-bis(2',4'-dimethylphenyl)-s-triazine according to H. Brunetti and C. E. Luthi (*Helv. Chim. Acta,* 1972, 55, 1566). Sulfonation with an equimolar amount of chlorosulfonic acid in boiling chlorobenzene for 1 h, and neutralisation with sodium carbonate, gave the sodium salt of 2,4-bis(2',4'-dimethylphenyl)-6-(2'',4''-dihydroxy-5''-sulfophenyl)-s-triazine as pale yellow needles (88% yield) after recrystallisation from aqueous ethanol. Elemental analysis: C, 57.1%; H, 4.9%; N, 7.9%; S, 6.1%. $C_{25}H_{22}N_3O_5SNa.1\frac{1}{2}H_2O$ requires C, 57.0%; H, 4.8%; N, 8.0%; S, 6.1%.

Acetylation of this product, by stirring with boiling acetic anhydride (20 volumes) for 2 h, gave the sodium salt of 2,4-bis(2',4'-dimethylphenyl)-6-(2''-hydroxy-4''-acetoxy-5''-sulfophenyl)-s-triazine in 84% yield. It crystallised from aqueous ethanol as colorless needles. Elemental analysis: C, 58.9%; H, 4.9%; N, 7.5%; S, 5.7%. $C_{27}H_{24}N_3O_6SNa.\frac{1}{2}H_2O$ requires C, 58.9%; H, 4.6%; N, 7.6%; S, 5.8%.

2,4-Bis(2'-hydroxy-5'-sulfophenyl)-6-phenyl-s-triazine, disodium salt

The above 2,4-bis(2'-hydroxyphenyl)-6-phenyl-s-triazine was stirred with 10 parts of fuming sulfuric acid (15% free $SO_3$) at 20° C. for 2 h. The resultant solution was poured onto iced water and neutralised with sodium hydroxide solution. Filtration gave the disulfonate (65% yield), which was purified by crystallisation from water, and then from aqueous methanol. Elemental analysis: C, 46.2%; H, 2.4%; N, 7.7%; S, 11.6%. $C_{21}H_{13}N_3O_8S_2Na_2$ requires C, 46.2%; H, 2.4%; N, 7.7%; S, 11.8%.

We claim:

1. A method for protecting proteinaceous fibres and blends thereof against photodegradation and thermal degradation which comprises treating the fibres under acidic conditions with a sulfonated s-triazine derivative of formula I or II;

I

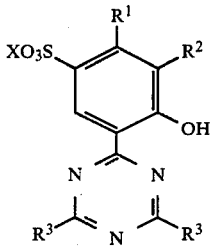

wherein $R^1$ is hydrogen, alkyl, hydroxyl, O-alkyl, OOC-alkyl or OOCNH-alkyl;

$R^2$ is hydrogen, alkyl or —$SO_3X$;

$R^3$ is aryl, substituted aryl or O-alkyl; and

X is hydrogen, $NH_4$ or alkali metal;

OR

II

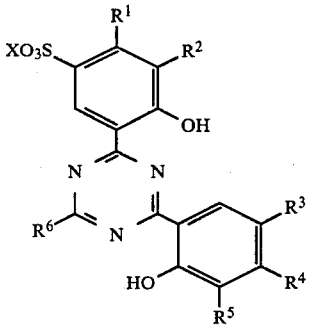

wherein $R^1$ and $R^4$ are hydrogen, alkyl, hydroxyl, O-alkyl, OOC-alkyl or OOCNH-alkyl;

$R^2$ and $R^5$ are hydrogen, alkyl or —$SO_3X$;

$R^3$ is hydrogen or —$SO_3X$;

$R^6$ is aryl, substituted aryl, O-alkyl or O-aryl; and

X is hydrogen, $NH_4$ or alkali metal.

2. A method as defined in claim 1, which is carried out at a pH within the range 1.5–6.

3. A method as defined in claim 1 or claim 2, in which the fibre is wool, either dyed or undyed, silk, mohair or cashmere, or a blend thereof.

4. A method as defined in any one of claims 1–3, in which the sulfonated s-triazine derivative is a compound of the formula I in which $R^1$ is a methoxy, ethoxy, propyloxy, butyloxy or acetoxy group, $R^2$ is hydrogen and $R^3$ is a phenyl group or an alkyl-substituted phenyl group, and X is sodium.

5. A method as defined in any one of claims 1–3, in which the sulfonated s-triazine derivative is a compound of the formula II in which $R^1$ and $R^4$ are methoxy, ethoxy, propyloxy, butyloxy or acetoxy groups, $R^2$ and $R^5$ are hydrogen, $R^3$ is hydrogen or a sulfonate group, $R^6$ is phenyl or alkyl-substituted phenyl and X is sodium.

6. A method as defined in any one of claims 1–3, in which the sulfonated s-triazine derivative is selected from the group consisting of: an ammonium, sodium or potassium salt of 2,4-diphenyl-6-(2'-hydroxy-4'-methoxy-5'-sulfophenyl)-s-triazine, 2,4-bis(2',4'-dimethylphenyl)-6-(2''-hydroxy-4''-acetoxy-5''-sulfophenyl)-s-triazine, 2,4-diphenyl-6-(2'-hydroxy-4'-n-butoxy-5'-sulfophenyl-s-triazine, 2,4-bis(2',4'-dimethylphenyl)-6-(2'-hydroxy-4''-methoxy-5''-sulfophenyl)-s-triazine, 2,4-diphenyl-6-(2'-hydroxy-4'-acetoxy-5'-sulfophenyl)-s-triazine, or 2,4-di-p-tolyl-6-(2'-hydroxy-4'-methoxy-5'-sulfophenyl)-s-triazine.

7. A method for protecting proteinaceous fibres and blends thereof against photodegradation and thermal degradation as defined in claim 1 and substantially as herein described.

8. A method for protecting dyed proteinaceous fibres and blends thereof against color change and photodegradation as defined in claim 1 and substantially as herein described.

9. Proteinaceous fibres and blends thereof whenever treated with a sulfonated s-triazine derivative of formula I or II as defined in claim 1.

* * * * *

UNITED STATES PATENT AND TRADEMARK OFFICE

CERTIFICATE OF CORRECTION

PATENT NO. : 4,698,064

DATED : October 6, 1987

INVENTOR(S) : Evans et al.

It is certified that error appears in the above-identified patent and that said Letters Patent is hereby corrected as shown below:

Column 3, line 64, underline the letter "s".
Column 3, line 65, underline the letter "n".
Column 4, line 27, underline the word "Lab".
Column 15, line 2, underline the letter "s".
Column 15, line 3, underline the letter "n".
Column 15, line 5, delete "2'" between the "(" and the word "-hydroxy" and insert --2"-- in its place.

Signed and Sealed this

Twenty-ninth Day of March, 1988

*Attest:*

*Attesting Officer*

DONALD J. QUIGG

*Commissioner of Patents and Trademarks*